US006135447A

United States Patent [19]

Lin

[11] Patent Number: 6,135,447

[45] Date of Patent: Oct. 24, 2000

[54] APPARATUS FOR SKEW CORRECTION IN CUT-SHEET PAPER FEEDING

[75] Inventor: Chin-I Lin, TaoYuan, Taiwan

[73] Assignee: Umax Data Systems Inc., Hsinchu, Taiwan

[21] Appl. No.: 09/191,536

[22] Filed: Nov. 13, 1998

[51] Int. Cl.[7] ..... B65H 9/14

[52] U.S. Cl. ..... 271/229; 271/245

[58] Field of Search ..... 271/245, 229, 271/226

[56] References Cited

U.S. PATENT DOCUMENTS

| | | | |
|---|---|---|---|
| 5,427,462 | 6/1995 | Jackson et al. | 400/579 |
| 5,596,399 | 1/1997 | Dempsey et al. | 271/245 X |
| 5,921,545 | 7/1999 | Kobayashi et al. | 271/245 X |

*Primary Examiner*—David H. Bollinger

*Attorney, Agent, or Firm*—Dougherty & Troxell

[57] ABSTRACT

A skew correction apparatus for cut-sheet paper feeding used in office machines such as optical scanners, printers and copiers. It includes a C-shaped paper guide surrounding a drive roller to form a paper passage therebetween. At one end of the paper guide, there is a concave groove and a slanted slot which holds an elastic plastic flap therein. The flap is spaced from a pinch roller which makes contact with the drive roller for feeding a sheet of paper from the paper passage to a working station for performing a desired work such as scanning, printing, and copying. The flap has a depending tongue to stop a skewed leading edge of a sheet of paper. The paper buckles behind the skewed leading edge caused by the rotating drive roller and is held in the concave groove until the trailing edge of the skewed paper reaches the flap. The leading edge thus is aligned properly without skew and pushes and deflects the tongue and moves to the pinch roller and the drive roller which move the paper to the working station.

10 Claims, 5 Drawing Sheets

APPARATUS FOR SKEW CORRECTION IN CUT-SHEET PAPER FEEDING

BACKGROUND OF THE INVENTION

1. Field of the Invention

This invention relates to an apparatus for skew correction in cut-sheet paper feeding used in an office equipment such as optical scanner, printer, copier and the like.

2. Description of the Prior Art

In various office machines that use cut-sheet paper feeding such as scanner, printer and copier, a stack of cut-sheet paper is usually placed in a paper tray. A paper pickup mechanism is employed to pick up a top sheet paper and feeds the paper into a paper passage formed between a drive roller and a paper guide. At the end of the paper passage, the drive roller and a pinch roller drive the paper to a working station for operation desired, e.g., scanning, printing, copying, or etc. During the paper being picked up and moved in the paper passage and being driven to the working station, the paper has to make frictional contact with a lot of mechanical means, such as the roller, paper guide, and machine casing. These mechanical means have different degree of friction force because of material property and wearing after long time of use. Paper property and conditions also will affect the friction force level. In addition, inappropriate operation of when stacking the sheet paper into the paper tray will also result in inappropriate alignment of sheet paper. Therefore after a sheet of paper travelling a long way and reaching the working station, the paper could become skew and not being aligned properly, and resulting in poor output quality. A severely skewed paper could also cause paper jam in the machine. Then the machine operation has to stop. It takes times and labor to fix such a problem. Worse, such an event takes place repetitively.

A low price office machine generally includes a movable side board in the paper tray to align paper feeding into the machine. However once the paper enters into the machine and moves along the paper passage before reaching the working station, there is no skew correction means. Some relatively high price office machine has included skew correction means for such purpose. U.S. Pat. No. 5,427,462 discloses such a method for printer. It includes a microprocessor controlled drive roller and a pinch roller that can rotate in reverse to make paper jiggling and dancing on its own weight so that skew leading edge may be made parallel to the roller before feeding for printing. It not only involves a complicated structure (e.g., a microprocessor for controlling the drive roller to rotate forward or backward, a depending plate with fingers to engage the paper, etc.) which needs additional space to accommodate those additional control means, but also the paper input is limited to upper feeding at about sixty degrees from horizontal to create paper jiggling needed, and is expensive to produce. All of this has restricted its applicability.

SUMMARY OF THE INVENTION

In view of aforesaid disadvantages, it is therefore an object of this invention to provide an apparatus for skew correction in cut-sheet paper feeding used in office machines that corrects paper skew before feeding to working station for producing higher quality output.

It is another object of this invention to provide a skew correction apparatus that contains a small number of parts and is simply structured so that it can be produced at low cost and be installed easily.

It is a further object of this invention to provide a skew correction apparatus that is compact and can be adapted to a wide variety of office machines such as scanner, printer and copier.

It is yet another object of this invention to provide a skew correction apparatus that is versatile in paper input method so that it can be employed in a wide range of different applications.

The skew correction apparatus according to this invention includes an elastic plastic flap slantly disposed in front of the contact of a drive roller and a pinch roller, and a concave groove in a paper guide to temporarily hold a buckling of a skew leading portion of the paper until the skew of the leading edge is corrected before feeding to the working station. No additional active component is added. It can be easily made at low cost and be included in an existing office machine without extra space.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
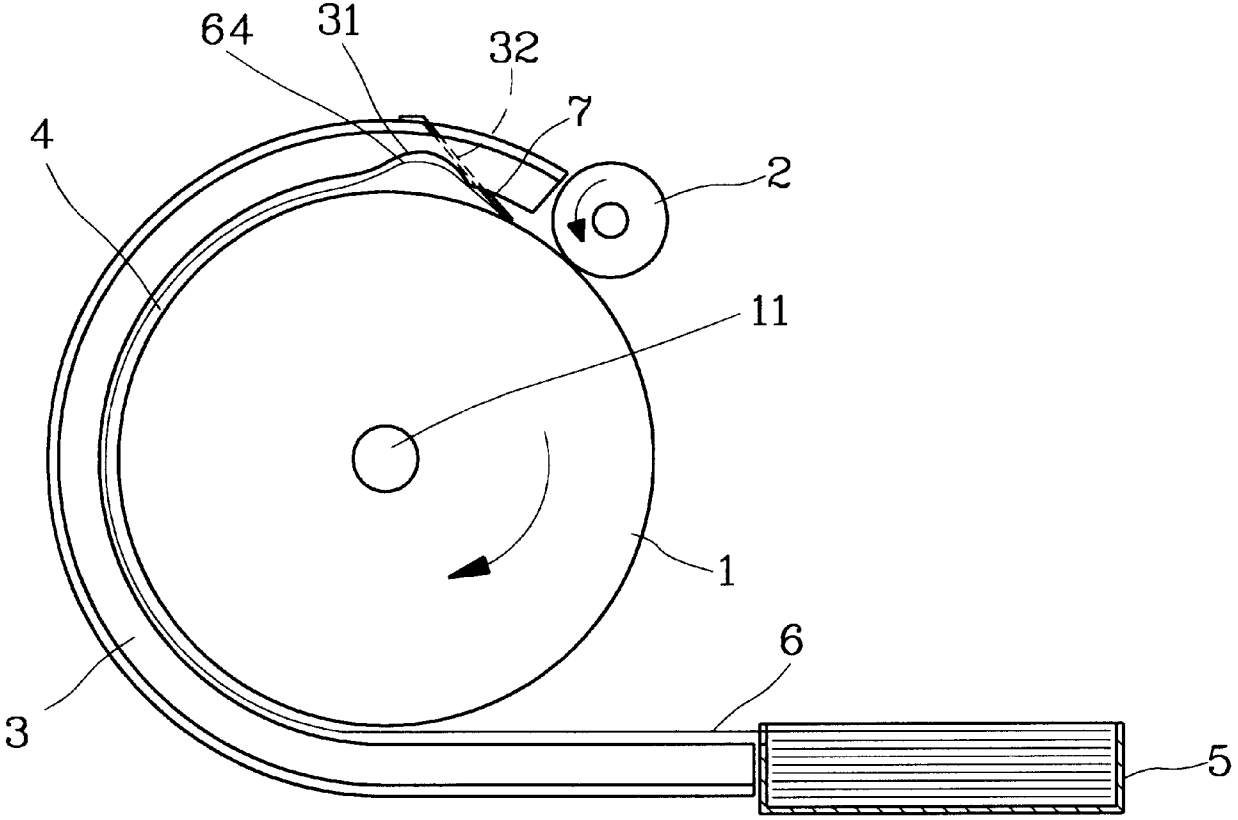
FIG. 1 is a side sectional view of this invention.
Figure 2:
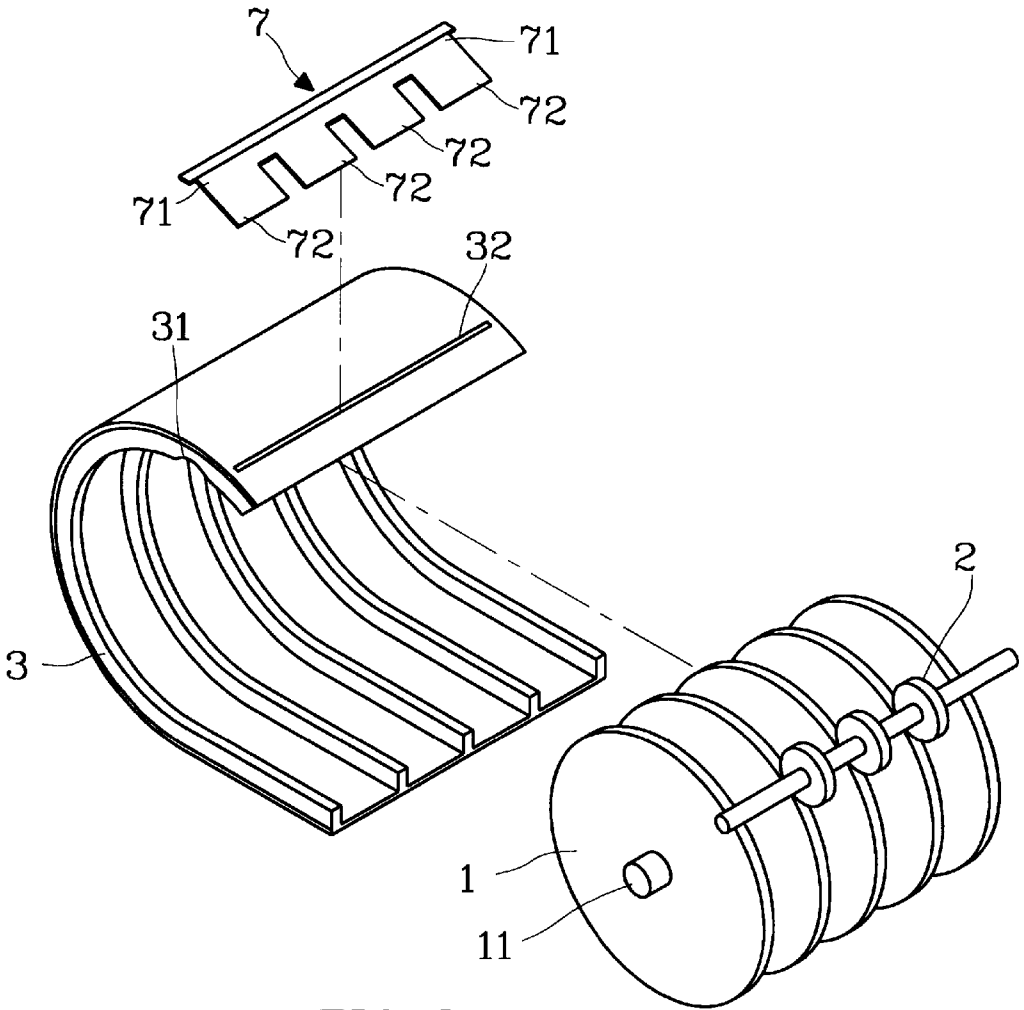
FIG. 2 is a fragmentary exploded view of this invention.

Referring to FIGS. 1 and 2, the skew correction apparatus according to this invention includes a drive roller 1 which has more than one roller wheel spaced from each other and mounted on a spindle 11 and being driven by a motor (not shown in the figures), a pinch roller 2 which is generally smaller than the drive roller 1 and being contact with the drive roller 1 and rotates in an opposite direction against the drive roller, and a paper guide 3 which includes a plurality of rib-like flanges formed substantially C-shaped with an inside curved surface surrounding the outside perimeter of the drive roller 1. The perimeter of the drive roller 1 and the inside of the flange of the paper guide 3 are spaced to form a paper passage 4 therebetween. At the end adjacent the pinch roller 2, the flange of the paper guide 3 has a concave groove 31. Beyond the groove 31 and toward the pinch roller 2 and near the end of the flange, there is provided with a slot 32 slantly formed toward the perimeter of the drive roller 1.

Figure 3:
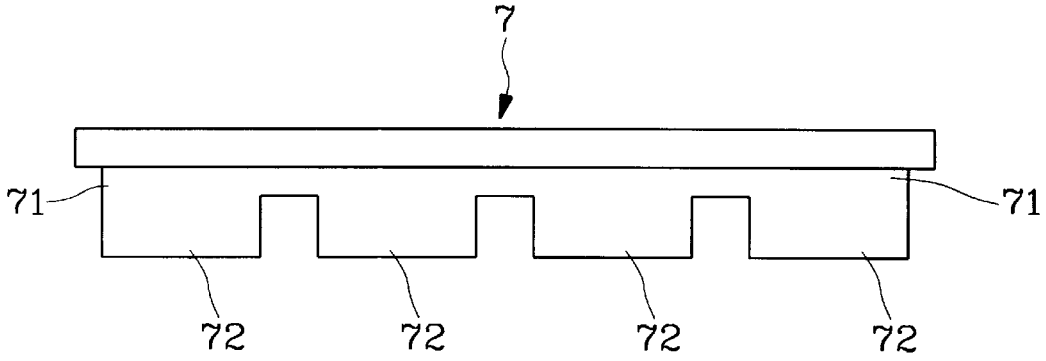
FIG. 3 is a top view of an embodiment of a plastic flap.
Figure 4:
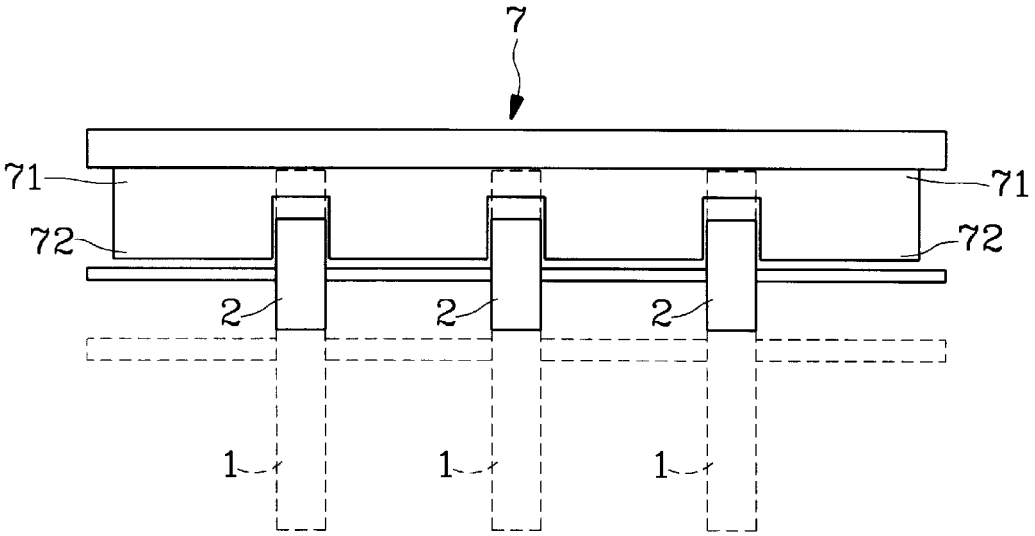
FIG. 4 is a fragmentary top view of this invention.
Figure 5:
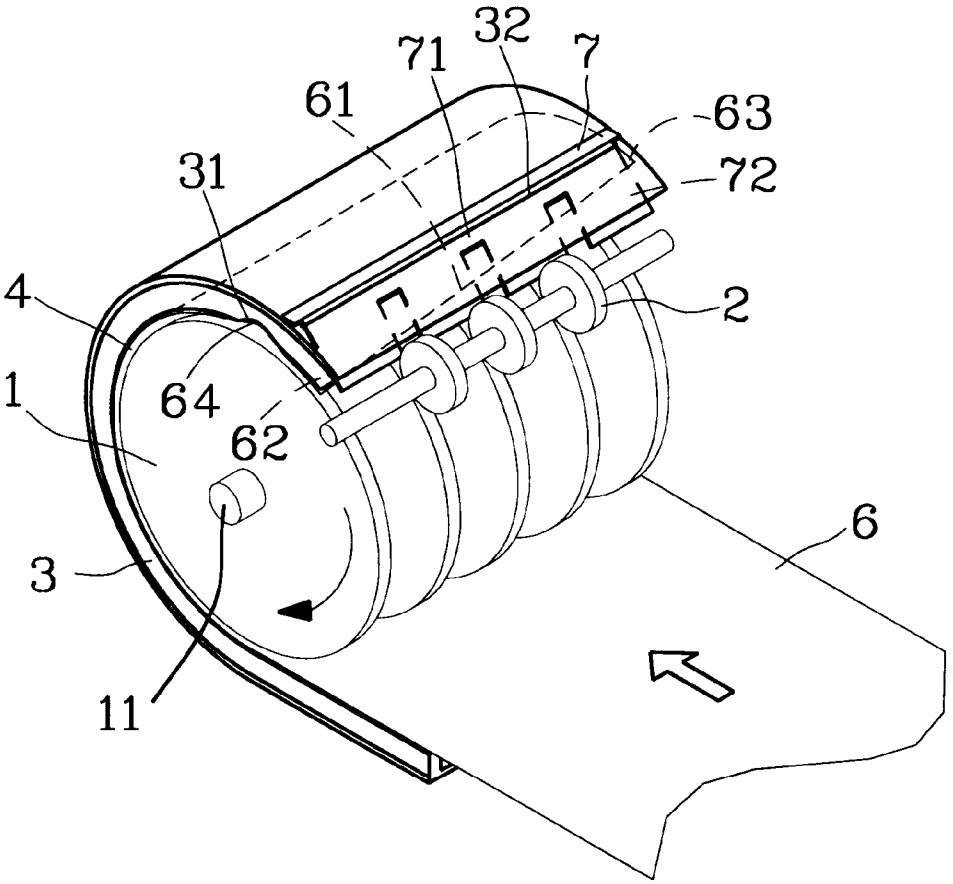
FIG. 5 is a fragmentary perspective view of this invention in use.

Referring to FIGS. 2 and 3, a plastic flap 7 such as mylar, is a thin plate made of an elastic material with a root section 71 held in the slot 32 and being positioned slightly against the drive roller 1, and at least one tongue section 72 depending between a pair of roller wheels (also shown in FIGS. 4 and 5). The plastic flap 7 is thus slantly positioned against the perimeter of the drive roller. The plastic flap 7 is spaced from the pinch roller 2 with a gap of about 1–2 mm. The groove 31 has a depth of about 3 mm, while the gap between the perimeter of the drive roller 1 and the paper guide 3, i.e., the width of the paper passage 4, is about 1 mm.

When in use (referring to FIGS. 1 and 5), a top sheet of paper 6 in a paper tray 5 is picked up by a paper pick up means (not shown in the figures). Carrying and dragging by the rotating drive roller 1, the paper 6 is moved in the paper passage 4 and reaches another end of the paper guide 3 before the flap 7. If the leading edge 61 of the paper 6 is properly aligned and without skew, the leading edge 61 of the paper 6 would be uniformly stopped by the tongues 72 of the flap 7 since the friction force between the flap 7 is greater than the driving force of the roller 1 (i.e., the friction force between the drive roller 1 and the leading edge 61). Then the leading section of the paper 6 behind the leading edge 61 buckles to form a curve shape which is just received within the concave groove 31. As the buckle portion of the leading section of the paper 6 increases its pushing force (due to stiffness of paper), thus the leading edge 61 deflects the tongue 72 of the flap 7, and keeps moving between the drive roller 1 and the pinch roller 2 which then feeds the paper to a working station (not shown in the figures) for an operation desired, such as scanning, printing, copying, etc. If the leading edge 61 (shown by a broken line in FIG. 5) is skew, a skewed and an advancing leading edge 62 will reach the tongue 72 first and be stopped there. Continuously rotating drive roller 1 will cause leading section of the paper 6 behind the leading edge 62 buckled. The buckling section is held in the concave groove 31 of the paper guide 3. After a short time period, a trailing edge 63 reaches the tongue 72, then the whole section of the leading edge 61, including 62 and 63 reaches the tongue 72 and being aligned properly. With the help of the drive rotor 1 and stiffness of the buckled portion of the paper 6 itself, the whole leading edge 61 has sufficient pushing force to advance and deflect the tongue 72 and reaches the pinch roller 2 for feeding to the working station. No matter the leading edge 61 is originally properly aligned or not, after stopped by the 7, flap being a bulge portion of the paper 6 will be formed and housed within the concave groove 31 for increasing pushing force to pass through the flap 7, and after passing through the 7, the leading edge 61 of the paper 6 will become properly aligned and flush with the outside perimeter of the drive roller 1 again.

To make this invention work, detailed and accurate analysis of paper property (such as stiffness, buckling, weight, thickness) and flap property (such as elasticity and friction parameters, thickness, width, length, etc.) should be done and included in the design to ensure that paper will have enough strength and stiffness to deflect the flap tongue when properly aligned, and will be stopped and buckled to a desired degree when skewed.

Figure 6:
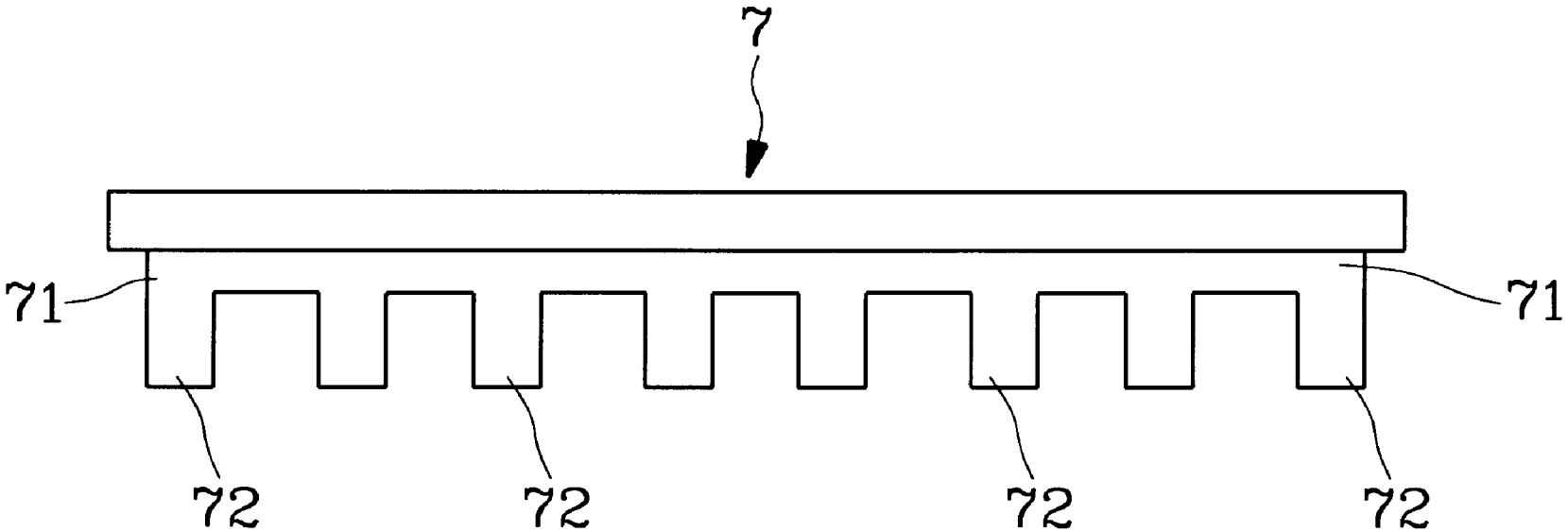
FIG. 6 is a top view of another embodiment of a plastic flap.

The shape of the flap 7 should also be properly designed. It is essential that it will touch and hold both ends of the leading edge of a feeding paper. FIGS. 3 and 4, show an embodiment which has a relatively wide tongue 72 between a pair of roller wheels of the drive roller 1. FIG. 6 shows another embodiment which has two relatively narrow and spaced tongues 72 between a pair of roller wheels.

This invention is applicable to any machine that uses cut sheet paper input, including, but not limited to optical scanners, printers, and copiers.

It may thus be seen that the objects of the present invention set forth herein, as well as those made apparatus from the foregoing description, are efficiently attained. While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An apparatus for skew correction in a cut-sheet paper feeding device, comprising:

a drive roller including at least one roller wheel mounted on a spindle driven by a motor, the roller wheel having a perimeter for moving a sheet of paper;

at least one pinch roller in contact with the perimeter of the roller wheel;

a paper guide formed in a substantially C-shape having an inside curve surrounding but spaced from the perimeter of the at least one roller wheel for forming a paper passage therebetween; a concave groove formed adjacent to one end thereof and a slanted slot located between the concave groove and said one end of the paper guide, and being spaced from the pinch roller; and an elastic flap having a root section held in the slanted slot and at least one depending tongue extending toward the drive roller and the pinch roller but spaced from the pinch roller.

2. The apparatus for skew correction of claim 1, wherein the flap has at least two tongues, one tongue located on both sides of the at least one roller wheel.

3. The apparatus for skew correction of claim 1, wherein the concave groove has a depth of approximately 3 mm.

4. The apparatus for skew correction of claim 1, wherein the flap is spaced from the pinch roller a distance no greater than 2 mm.

5. The apparatus for skew correction of claim 1, wherein the at least one tongue is located between a pair of roller wheels.

6. The apparatus for skew correction of claim 1, wherein the flap has at least two spaced tongues which are located between a pair of roller wheels.

7. The apparatus for skew correction of claim 1, wherein the flap is made of an elastic plastic material.

8. The apparatus for skew correction of claim 1, wherein the paper guide comprises a part of an optical scanner.

9. The apparatus for skew correction of claim 1, wherein the paper guide comprises a part of a printer.

10. The apparatus for skew correction of claim 1, wherein the paper guide comprises part of a copier.

* * * * *